US006988557B2

(12) United States Patent
Whanger et al.

(10) Patent No.: US 6,988,557 B2
(45) Date of Patent: Jan. 24, 2006

(54) SELF SEALING EXPANDABLE INFLATABLE PACKERS

(75) Inventors: James K. Whanger, Houston, TX (US); James Oliver, Sugar Land, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 192 days.

(21) Appl. No.: 10/443,442

(22) Filed: May 22, 2003

(65) Prior Publication Data

US 2004/0231861 A1 Nov. 25, 2004

(51) Int. Cl.
*E21B 23/00* (2006.01)

(52) U.S. Cl. ..... 166/380; 166/384; 166/207
(58) Field of Classification Search ..... 166/380, 166/384, 207, 186
See application file for complete search history.

(56) References Cited

U.S. PATENT DOCUMENTS

| | | | | |
|---|---|---|---|---|
| 2,306,160 A | | 12/1942 | Freyssinet | 288/6 |
| 2,519,116 A | | 8/1950 | Crake | 166/10 |
| 2,656,891 A | | 10/1953 | Toelke | 166/13 |
| 2,814,517 A | | 11/1957 | Razdow | 288/20 |
| 2,945,541 A | | 7/1960 | May et al. | 166/187 |
| 3,083,775 A | | 4/1963 | Nielson et al. | |
| 3,147,016 A | | 9/1964 | Traufler | 277/226 |
| 3,385,367 A | | 5/1968 | Kollsman | 166/191 |
| 3,593,799 A | | 7/1971 | Boughton et al. | 166/295 |
| 3,677,987 A | | 7/1972 | Pence, Jr. | 260/29.6 |
| 3,690,375 A | | 9/1972 | Shillander | 166/187 |
| 3,740,360 A | | 6/1973 | Nimerick | 260/17.4 |
| 3,918,523 A | | 11/1975 | Stuber | 166/285 |
| 4,078,606 A | | 3/1978 | Montgomery | 166/120 |
| 4,137,970 A | | 2/1979 | Laflin et al. | 166/292 |
| 4,244,590 A | * | 1/1981 | Sanford | 277/333 |
| 4,253,676 A | | 3/1981 | Baker et al. | 277/34.6 |
| 4,300,775 A | | 11/1981 | Ringel | 277/34.3 |
| 4,403,660 A | | 9/1983 | Coone | 166/387 |
| 4,406,469 A | | 9/1983 | Allison | 277/123 |
| 4,452,463 A | | 6/1984 | Buckner | 277/120 |
| 4,457,369 A | | 7/1984 | Henderson | 166/125 |
| 4,545,433 A | | 10/1985 | Wambaugh | |

(Continued)

FOREIGN PATENT DOCUMENTS

| | | |
|---|---|---|
| EP | 0 237 662 | 9/1987 |
| GB | 2 308 138 | 6/1997 |
| GB | 2 371 064 | 7/2002 |
| WO | WO 02/20941 | 3/2002 |
| WO | WO 02/25059 | 3/2002 |
| WO | WO 02/059452 | 8/2002 |

OTHER PUBLICATIONS

U.S. Appl. No. 10/328,708, filed Dec. 23, 2002, Whanger et al.

(Continued)

*Primary Examiner*—William Neuder
(74) *Attorney, Agent, or Firm*—Moser, Patterson & Sheridan

(57) ABSTRACT

The present invention generally relates to a sealing apparatus for isolating a wellbore. In one aspect, the present invention provides an expandable sealing apparatus having an expandable tubular and a sealing element disposed around the tubular. A chamber for maintaining a fluid is defined between the sealing element and the tubular. The sealing apparatus also includes a self-isolating layer disposed in the chamber, wherein the self-isolating layer is adapted and arranged to regulate fluid flow through the chamber. Fluid supplied to the chamber may inflate the sealing element, thereby urging the sealing element into contact with the wellbore. When the pressure in the tubular is released, the pressure in the chamber causes the self-isolating layer to close off, thereby retaining the pressure in the chamber.

31 Claims, 12 Drawing Sheets

U.S. PATENT DOCUMENTS

| | | | | |
|---|---|---|---|---|
| 4,601,498 | A | 7/1986 | Haugen | 285/332.3 |
| 4,633,950 | A | 1/1987 | Delhommer et al. | 166/295 |
| 4,662,450 | A | 5/1987 | Haugen | 166/299 |
| 4,674,570 | A | 6/1987 | Jackson | 166/187 |
| 4,730,670 | A | 3/1988 | Kim | 166/134 |
| 4,762,179 | A | 8/1988 | Wesson et al. | 166/297 |
| 4,836,940 | A | 6/1989 | Alexander | 252/8.512 |
| 4,862,967 | A | 9/1989 | Harris | 166/387 |
| 4,886,117 | A | 12/1989 | Patel | 166/187 |
| 4,907,651 | A | 3/1990 | Bou-Mikael | 166/114 |
| 4,913,232 | A | 4/1990 | Cheymol et al. | 166/285 |
| 4,919,989 | A | 4/1990 | Colangelo | |
| 4,936,386 | A | 6/1990 | Colangelo | |
| 5,086,841 | A | 2/1992 | Reid et al. | 166/295 |
| 5,165,703 | A | 11/1992 | Morvant | 277/188 |
| 5,226,492 | A | 7/1993 | Solaeche P. et al. | 166/196 |
| 5,271,469 | A | 12/1993 | Brooks et al. | 166/387 |
| 5,309,993 | A | 5/1994 | Coon et al. | 166/115 |
| 5,311,938 | A | 5/1994 | Hendrickson et al. | 166/134 |
| 5,511,620 | A | 4/1996 | Baugh et al. | 166/387 |
| 5,605,195 | A | 2/1997 | Eslinger et al. | 166/387 |
| 5,623,993 | A | 4/1997 | Van Buskirk et al. | 166/292 |
| 5,676,384 | A | 10/1997 | Culpepper | 277/188 |
| 5,749,585 | A | 5/1998 | Lembcke | 277/116.2 |
| 5,787,987 | A | 8/1998 | Forsyth et al. | 166/313 |
| 5,803,178 | A | 9/1998 | Cain | 166/306 |
| 5,833,001 | A | 11/1998 | Song et al. | 166/287 |
| 5,875,847 | A | 3/1999 | Forsyth | 166/313 |
| 5,941,313 | A | 8/1999 | Arizmendi | 166/387 |
| 6,009,951 | A | 1/2000 | Coronado et al. | 166/387 |
| 6,041,858 | A | 3/2000 | Arizmendi | 166/187 |
| 6,073,692 | A * | 6/2000 | Wood et al. | 166/187 |
| 6,425,444 | B1 | 7/2002 | Metcalfe et al. | |
| 6,446,717 | B1 | 9/2002 | White et al. | 166/187 |
| 6,457,518 | B1 * | 10/2002 | Castano-Mears et al. | 166/207 |
| 6,702,030 | B2 | 3/2004 | Simpson | |

OTHER PUBLICATIONS

U.S. Appl. No. 10/317,843, filed Dec. 12, 2002, Whanger et al.

U.S. Appl. No. 10/255,571, filed Sep. 26, 2002, Stephenson.

U.S. Appl. No. 10/034,592, filed Dec. 28, 2001, Lauritzen et al.

European Search Report, Application No. 04076500.0–2315, dated Sep. 8, 2004.

* cited by examiner

SELF SEALING EXPANDABLE INFLATABLE PACKERS

BACKGROUND OF THE INVENTION

1. Field of the Invention

Aspects of the present relate to a sealing apparatus. Particularly, the present invention relates to an expandable sealing apparatus. More particularly, the present invention relates to an expandable sealing apparatus for isolating sections of a wellbore.

2. Description of the Related Art

In the oil and gas exploration and production industry, boreholes are drilled through rock formations to gain access to hydrocarbon-bearing formations, to allow the hydrocarbons to be recovered to surface. During drilling of a typical borehole, which may be several thousand feet in length, many different rock formations are encountered.

Rock formations having problematic physical characteristics, such as high permeability, may be encountered during the drilling operation. These formations may cause various problems such as allowing unwanted water or gases to enter the borehole; crossflow between high and low pressure zones; and fluid communication between a highly permeable formation and adjacent formations. In instances where a sub-normal or over-pressured formation is sealed off, the permeability of the formation may be such that high pressure fluids permeate upwardly or downwardly, thereby re-entering the borehole at a different location.

Damage to rock formations during drilling of a borehole may also cause problems for the drilling operation. Damage to the formation may be caused by the pressurized drilling fluid used in the drilling operation. In these situations, drilling fluid may be lost into the formation. Loss of drilling fluid may cause the drilling operation to be halted in order to take remedial action to stabilize the rock formation. Loss of drilling fluid is undesirable because drilling fluids are typically expensive. In many cases, drilling fluids are re-circulated and cleaned for use in subsequent drilling procedures in order to save costs. Therefore, loss of high quantities of drilling fluid is unacceptable.

One method of overcoming these problems involves lining the borehole with a casing. This generally requires suspending the casing from the wellhead and cementing the casing in place, thereby sealing off and isolating the damaged formation. However, running and cementing additional casing strings is a time-consuming and expensive operation.

Furthermore, due to the installation of the casing, the borehole drilled below the casing has a smaller diameter than the sections above it. As the borehole continues to be extended and casing strings added, the inner diameter of the borehole continues to decrease. Because drilling operations are carefully planned, problematic formations unexpectedly encountered may cause the inner diameter of the borehole to be overly restricted when additional casing strings are installed. Although this may be accounted for during planning, it is generally undesired and several such occurrences may cause a reduction in final bore diameter, thereby affecting the future production of hydrocarbons from the well.

Alternatively, inflatable packers may be used to seal off a portion of a wellbore. Typically, the inflatable packer utilizes an inflatable elastomeric bladder to create a fluid seal within the surrounding wellbore or casing. The bladder may be inflated by injecting fluid under pressure into the bladder. In this manner, the bladder is inflated into contact with the wellbore. Typically, the pressure in the bladder is increased to greater than that of the pore pressure of the formation. In this respect, a net seal load is created, thereby sealing off the wellbore.

While the inflatable packer is a viable method of sealing a wellbore, there are potential problems associated with its application. For example, the actuation of the inflatable packer is operated through a complex valve system that may not function properly. Also, like the casing strings, the inflatable packer reduces the inner diameter of the wellbore, thereby potentially limiting the production capacity of the wellbore.

More recently, expandable tubular technology has been developed to install casing strings without significantly decreasing the inner diameter of the wellbore. Generally, expandable technology enables a smaller diameter tubular to pass through a larger diameter tubular, and thereafter be expanded to a larger diameter. In this respect, expandable technology permits the formation of a tubular string having a substantially constant inner diameter, otherwise known as a monobore. Accordingly, monobore wells have a substantially uniform through-bore from the surface casing to the production zones.

A monobore well features each progressive borehole section being cased without a reduction of casing size. The monobore well offers the advantage of being able to start with a much smaller surface casing but still end up with a desired size of production casing. Further, the monobore well provides a more economical and efficient way of completing a well. Because top-hole sizes are reduced, less drilling fluid is required and fewer cuttings are created for cleanup and disposal. Also, a smaller surface casing size simplifies the wellhead design as well as the blow out protectors and risers. Additionally, running expandable liners instead of long casing strings will result in valuable time savings.

Expandable tubular technology has recently been applied to cased hole packers. It has been discovered that expandable packers can be expanded in situ so as to enlarge the inner diameter. This, in turn, enlarges the path through which both fluid and downhole tools may travel. Expandable packers are expanded through the use of a cone-shaped mandrel or by an expansion tool with expandable, fluid actuated members disposed on a body and run into the wellbore on a tubular string. During the expansion operation, the walls of the expandable packer are expanded past their elastic limit. The expandable packer may be expanded against an existing casing to hang a string of casing or seal off an annular area. Consequently, expandable packers allow for the use of larger diameter production tubing, because the conventional slip mechanism and sealing mechanism are eliminated.

An expandable packer is typically run into the wellbore with a running assembly disposed at an end of a drill string. The running assembly generally includes an expansion tool, a swivel, and a running tool. The expansion tool is disposed at the bottom end of the drill string. Next, the swivel is disposed between the expansion tool and the running tool to allow the expansion tool to rotate while the running tool remains stationary. Finally, the running tool is located below the swivel, at the bottom end of the running assembly. The running tool is mechanically attached to the expandable packer through a mechanical holding device.

After the expandable packer is lowered to a predetermined point in the well, the expandable packer is ready to be expanded into contact with the wellbore or casing. Subsequently, the expansion tool is activated when a hydraulic isolation device, like a ball, is circulated down into a seat in the expansion tool. Thereafter, fluid is pumped from the surface of the wellbore down the drill string into the expansion tool. When the fluid pressure builds up to a predetermined level, the expansion tool is activated, thereby starting the expansion operation. During the expansion operation, the swivel allows the expansion tool to rotate while the packer and the running tool remain stationary. After the expandable packer has been expanded against the wellbore or casing, the running assembly is deactivated and removed from the well.

While expanding tubulars in a wellbore offer obvious advantages, there are problems associated with using the technology to create a packer through the expansion of one tubular into a wellbore or another tubular. For example, an expanded packer with no gripping structure on the outer surface has a reduced capacity to support the weight of the entire packer. This is due to a reduced coefficient of friction on the outer surface of the expandable packer. Also, the expandable packer may not expand sufficiently to contact the wellbore and form a seal therewith. More importantly, the expansion of the expandable packer in an open-hole wellbore may result in an ineffective seal between the expanded packer and the surrounding wellbore.

There is a need, therefore, for a packer that will create an effective seal by exerting pressure against a cased wellbore or an open-hole wellbore. There is a further need for a packer that will not reduce the diameter of the wellbore. There is yet a further need for a packer that will expand sufficiently to form a seal with the wellbore.

SUMMARY OF THE INVENTION

The present invention generally relates to a sealing apparatus for isolating a wellbore. In one aspect, the present invention provides an expandable sealing apparatus having an expandable tubular and a sealing element disposed around the tubular. A chamber for maintaining a fluid is defined between the sealing element and the tubular. The sealing apparatus also includes a self-isolating layer disposed in the chamber, wherein the self-isolating layer is adapted and arranged to regulate fluid flow through the chamber. Fluid supplied to the chamber may inflate the sealing element, thereby urging the sealing element into contact with the wellbore. The pressure in the chamber causes the self-isolating layer to close off, thereby retaining the pressure in the chamber.

In another aspect, the present invention provides a method for isolating a wellbore. The method includes running a sealing apparatus into the wellbore. The sealing apparatus having a tubular body; a sealing element disposed around the tubular body; and a self-isolating layer disposed between the tubular body and the sealing element. The method further includes expanding the sealing apparatus and inflating the sealing element. Preferably, the pressure in the inflated sealing element is greater than the pore pressure of the formation.

In another embodiment, the method may also include supplying fluid into a chamber defined by the tubular body and the sealing element to expand the sealing apparatus. The fluid may be regulated to create a pressure differential between the chamber and the tubular body. The pressure differential causes the self-isolating screen to close, thereby retaining the pressure necessary to inflate the sealing element.

In another aspect still, the present invention provides a seal assembly. The seal assembly includes an expandable tubular and a sealing member disposed at each end of the tubular. The sealing members may straddle a section of the wellbore to isolate that section from other sections of the wellbore.

BRIEF DESCRIPTION OF THE DRAWINGS

So that the manner in which the above recited features of the present invention, and other features contemplated and claimed herein, are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
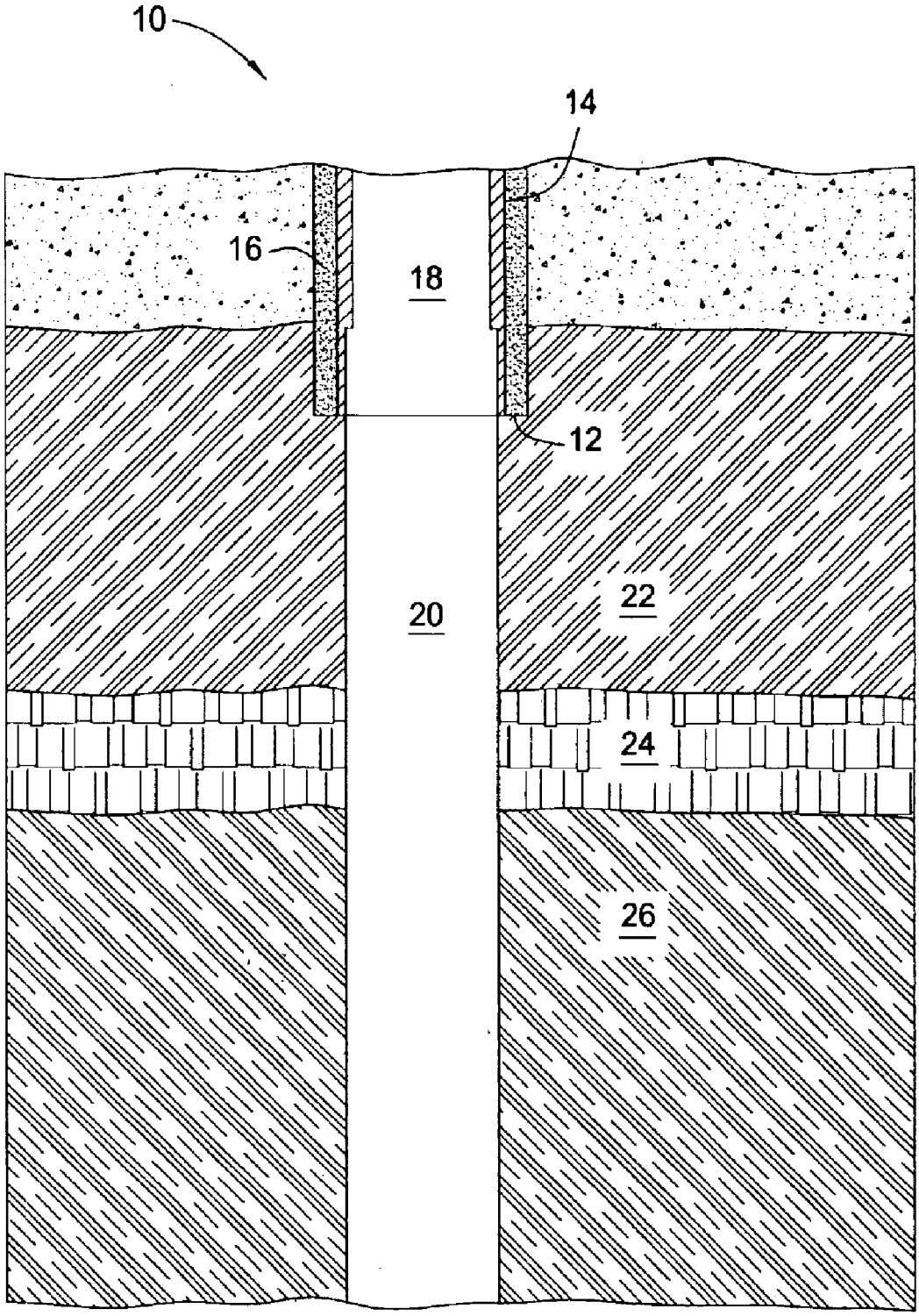
FIG. 1 is a schematic cross-sectional view of a partially completed wellbore.

FIG. 1 is a schematic illustration of a partially completed wellbore 10. The wellbore 10 is initially drilled to a first depth 12 and may be logged to determine certain geological characteristics of the rock formations in the region of the wellbore 10. As shown, a casing 14 has been installed in an upper portion 18 of the wellbore 10 and cemented 16 into place. Thereafter, the wellbore 10 is extended by drilling a smaller diameter wellbore section 20 below the casing 14 through a number of rock formations illustrated at 22–26.

In this example, during drilling of the wellbore section 20, the rock formation 24 was unexpectedly found to be highly permeable, and drilling fluid has been lost into the formation 24. Loss of drilling fluid may be detected by a loss of circulation and a drop in the pit volume of drilling fluid. As a result, drilling operations have been suspended.

Figure 2:
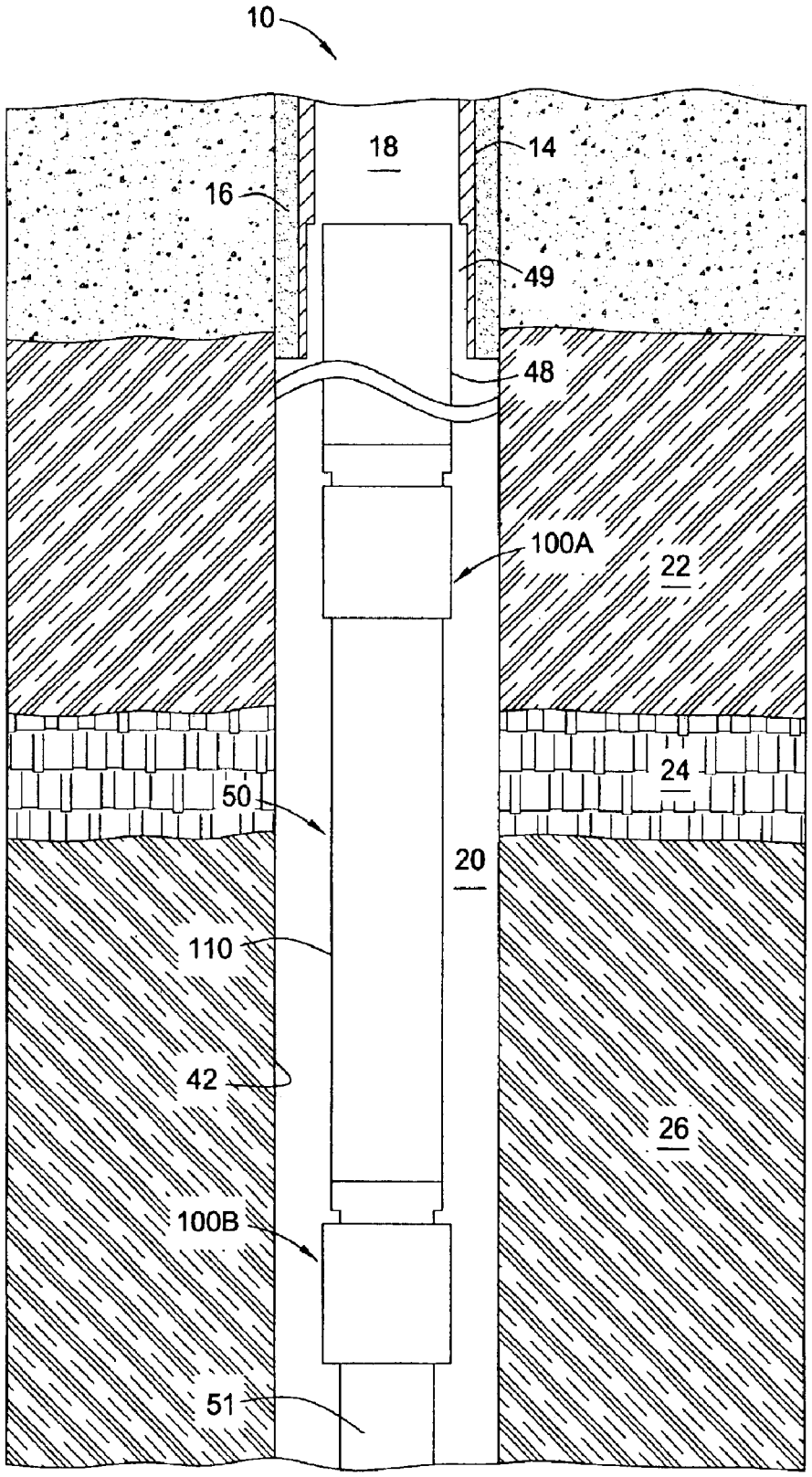
FIG. 2 is a schematic view of a seal assembly according to aspects of the present invention disposed in the wellbore of FIG. 1. The seal assembly is shown in the unexpanded configuration.

To prevent further loss of drilling fluid into the formation 24 and continue well completion operations, a seal assembly 50 according to aspects of the present invention is located in the wellbore 10 as illustrated in FIG. 2. The seal assembly 50 includes a first sealing member 100A and a second sealing member 100B disposed at each end of an expandable tubular 110. In this embodiment, each of the sealing members 100A, 100B are similarly constructed. It is understood that the expandable tubular 110 may include one or more tubulars connected together. Additionally, the expandable tubular 110 may include any suitable expandable tubular for wellbore operations, including expandable solid tubulars, expandable slotted tubulars, and expandable screens.

Initially, the wellbore 10 is underreamed to form a larger bore diameter 42 before the seal assembly 50 is installed as illustrated in FIG. 2. Thereafter, the seal assembly 50 is located in the wellbore 10 to isolate the rock formation 24. Specifically, the seal assembly 50 is positioned such that the sealing members 100A, 100B straddle the formation 24 to be blocked off. The seal assembly 50 is run into the wellbore 10 on an upper string of expandable solid tubular 48 adapted and arranged to locate the seal assembly 50 in the underreamed section 42. The upper string 48 is suspended from the casing 14 by an expandable liner packer 49. A lower string of tubular 51 may be attached below the seal assembly 50 to facilitate other operations downhole.

Figure 3:
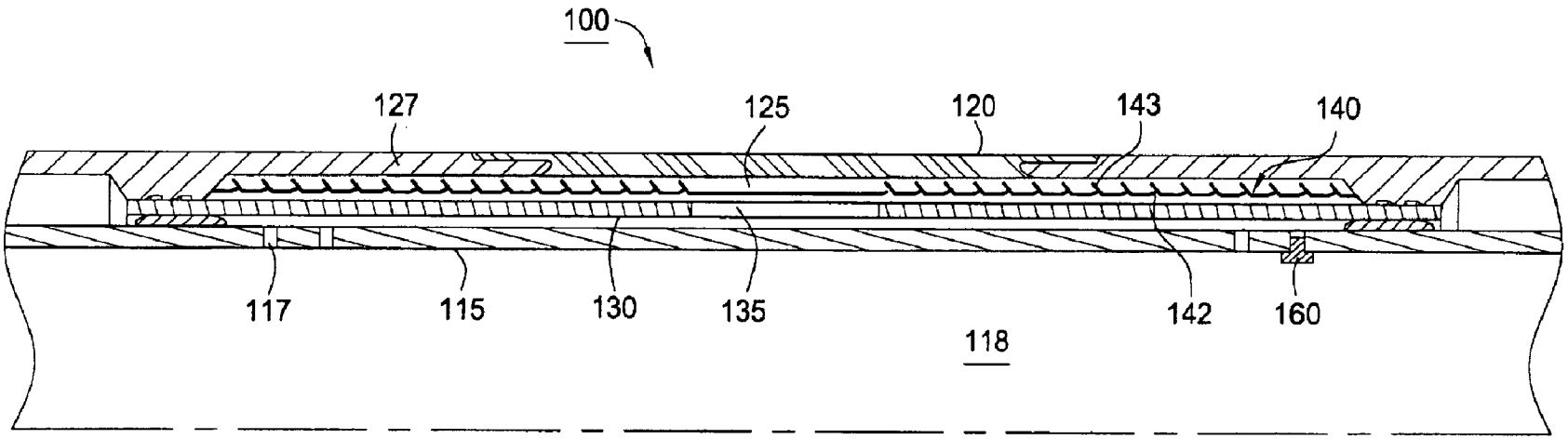
FIG. 3 is a partial cross-sectional view of one embodiment of the sealing member of the present invention. The sealing member is shown in the unactuated configuration.

FIG. 3 depicts a sectional view of a sealing member 100 suitable for use with the seal assembly 50 according to aspects of the present invention. The sealing member 100 includes an expandable mandrel 115 and an inflatable sealing element 120 mounted on the mandrel 115. The sealing element 120 may be made from any suitable expandable material, including an elastomeric material such as a swelling elastomer or a rubber material such as natural rubber. A chamber 125 is defined between the sealing element 120 and the mandrel 115. One or more ports 117 may be formed in the mandrel 115 to provide fluid communication between the bore 118 of the mandrel 115 and the chamber 125. Fluid supplied to the chamber 125 may serve to inflate the sealing element 120. A series of reinforcing ribs 127 are disposed at each end of the sealing element 120 to provide support for the sealing element 120 after inflation. The ribs 127 may be made of metal, composite, carbon-fiber or other suitable material as is known to a person of ordinary skill in the art. FIG. 3 depicts the sealing member 100 in the run-in uninflated position.

In one aspect, the sealing member 100 may include a self-isolating mechanism to maintain the sealing element 120 in an inflated state. In one embodiment, a permeable membrane 130 may be disposed between the mandrel 115 and the sealing element 120. The membrane 130 may be made of Teflon or an elastomeric material such as rubber. The permeable membrane 130 may include one or more openings 135 for fluid communication.

A self-isolating screen 140 may be disposed around the permeable membrane 130. The self-isolating screen 140 is adapted and arranged to maintain the pressure in the chamber 125 after the sealing element 120 is inflated. The screen 140 includes one or more apertures 142 for fluid communication. Each of the apertures 142 is provided with a flow control member 143 to regulate the flow of fluid therethrough. An exemplary flow control member 143 includes a flap 143 connected to the screen 140 at one end and unsecured at another end as shown in FIG. 3. Preferably, the flap 143 is located interior to the chamber 125 and is of sufficient size to cover or close off the respective aperture 142. The flaps 143 are actuatable by a pressure differential between the bore 118 and the chamber 125. During inflation, the flap 143 may be caused to flex away from aperture 142 to allow fluid to flow into the chamber 125, thereby inflating the sealing element 120. Conversely, the flap 143 may flex toward the aperture 142 to seal off the chamber 125, thereby isolating the pressure in the chamber 125. In one embodiment, self-isolating screen 140 may be made of metal. In another embodiment, a sealing material may be disposed around the perimeter of the flap 143 to facilitate closure of the aperture 142.

Figure 4:
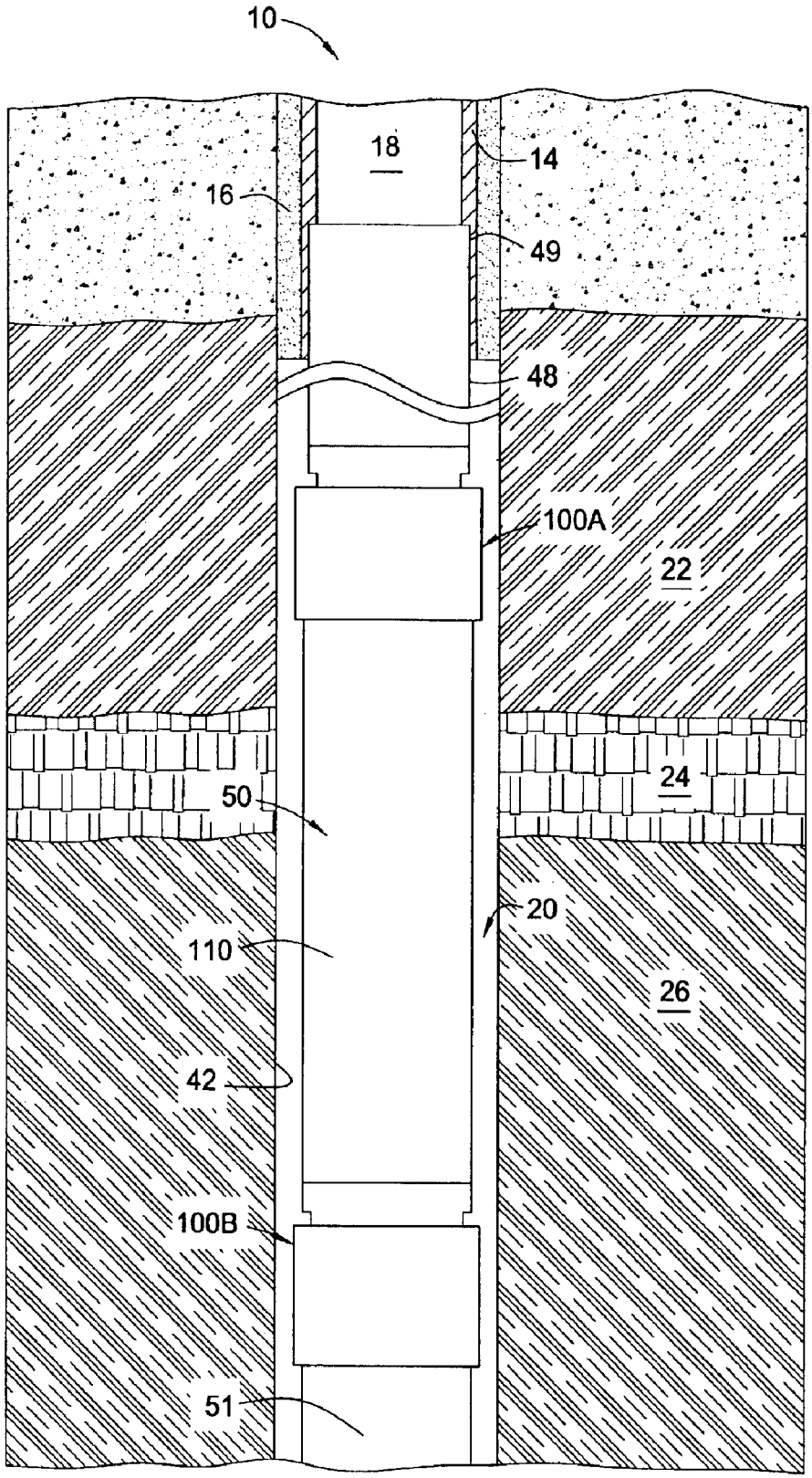
FIG. 4 is a schematic view of the seal assembly of FIG. 2 in the expanded, uninflated configuration.

In operation, the seal assembly 50 is formed by connecting a sealing member 100A, 100B at each end of an expandable tubular 110. The seal assembly 50 is disposed in the wellbore as shown in FIG. 2. Thereafter, an expander tool is employed to expand the seal assembly 50. Expansion of the seal assembly 50 brings the sealing members 100A, 100B closer to the wall 42 of the wellbore (or into contact with the wall 42), as illustrated in FIG. 4. Particularly, the expandable mandrels 115 are expanded to a greater internal diameter, thereby causing a corresponding expansion of the sealing elements 100A, 100B. It is understood that the sealing elements 100A, 100B may be expanded into contact with the wellbore wall without deviating from the aspects of the present invention.

Any suitable expander tool known to a person of ordinary skill in the art may be utilized to expand the seal assembly 50. An exemplary expander tool is disclosed in Simpson, U.S. Pat. No. 6,457,532, issued on Oct. 1, 2002, which patent is herein incorporated by reference in its entirety. In one embodiment, the expander tool may include a rotary expander tool acting outwardly against the inside surface of the seal assembly 50. The expander tool has a body, which is hollow and generally tubular with connectors and for connection to other components of a downhole assembly. The connectors are of a reduced diameter compared to the outside diameter of the longitudinally central body part of the expander tool. The central body part of the expander tool has three recesses, each holding a respective roller. Each of the mutually identical rollers is somewhat cylindrical and barreled. Each of the rollers is mounted by means of an axle at each end of the respective roller and the axles are mounted in slidable pistons. The rollers are arranged for rotation about a respective rotational axis that is parallel to the longitudinal axis of the expander tool and radially offset therefrom at 120-degree mutual circumferential separations around the central body. The pistons are sealed within each recess and are radially extendable therein. The inner end of each piston is exposed to the pressure of fluid within the core of the tool by way of the radial perforations in the core. In this manner, pressurized fluid provided from the surface of the well, can actuate the pistons and cause them to extend outward whereby the rollers contact the inner wall of the seal assembly 50 to be expanded. Other exemplary expander tools include a cone-shaped mandrel that can be axially traversed to expand the seal assembly 50. The expander tool is retrieved at the completion of the expansion.

Figure 5:
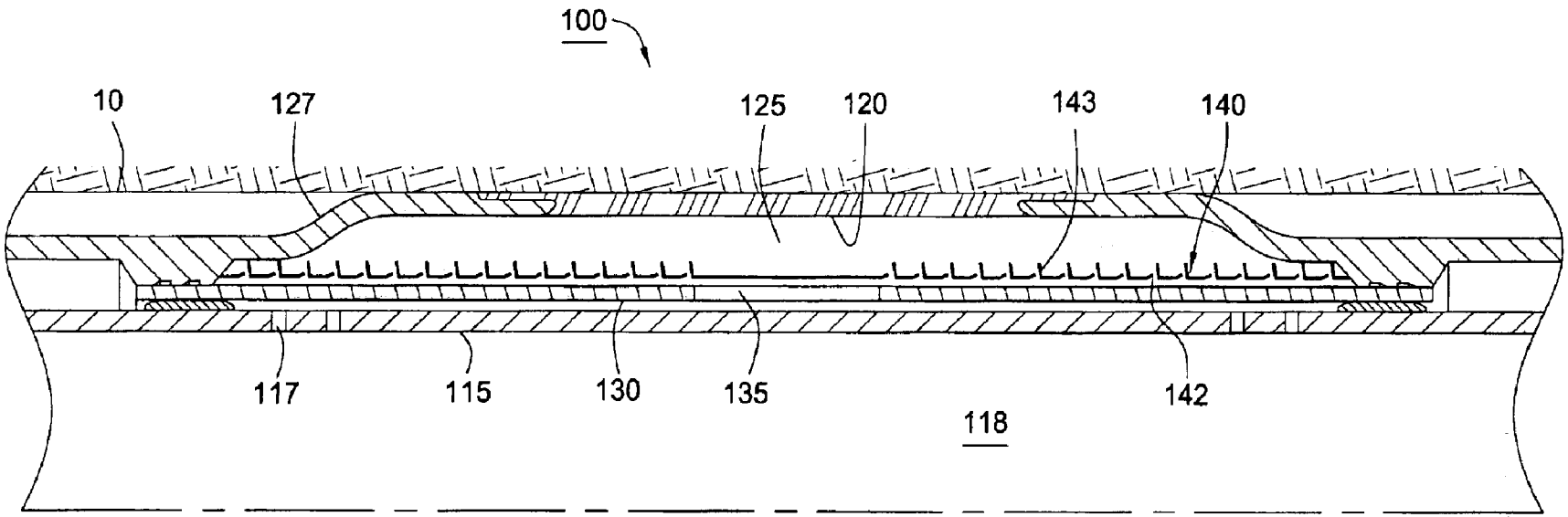
FIG. 5 is a partial cross-sectional view of the sealing member of FIG. 3 during inflation.

The sealing members 100A, 100B may now be inflated to seal off the wellbore 10. A fluid from the surface is supplied to the chambers 125 of the sealing members 100A, 100B to inflate the sealing elements 120. Preferably, the fluid is inert to the well and drilling fluids. An inflation tool may be used to supply the fluid under pressure to the chambers 125. The fluid is initially forced through the ports 117 of the mandrel 115 and then through the openings 135 of the permeable membrane 130. Thereafter, the fluid flow past the apertures 142 of the self-isolating screen 140 and exit into the chamber 125, thereby inflating the chamber 125. FIG. 5 illustrates the seal 100 during the inflation process. As shown, the pressurized fluid causes the flap 143 to flex away from the aperture 142, thereby opening the aperture 142 for fluid communication. Consequently, the sealing element 120 is expanded into contact with the wellbore 10. In this respect, a large pressure energized seal load is generated between the sealing member 100 and the wellbore 10 to provide the desired zone isolation.

Figure 6:
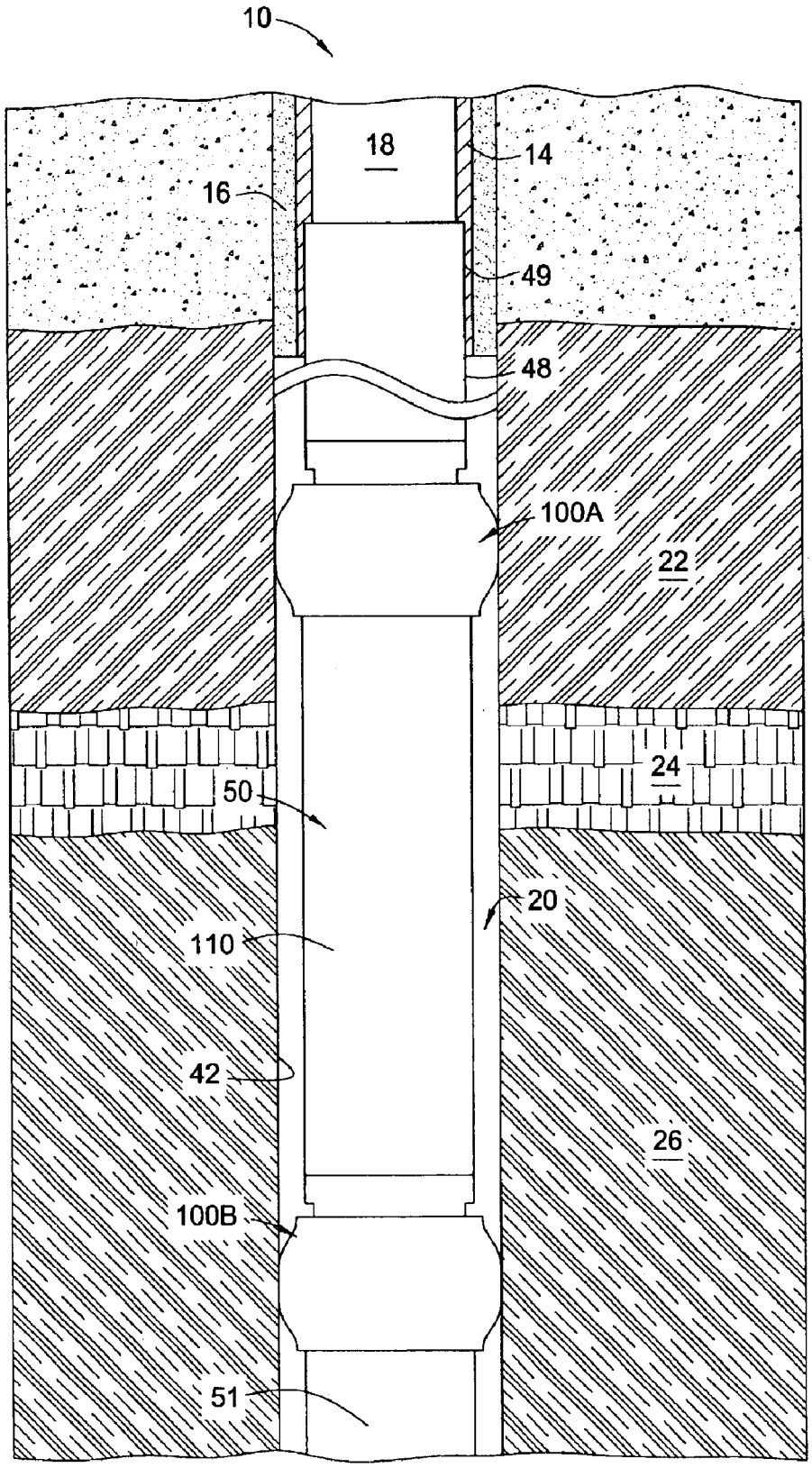
FIG. 6 is a schematic view of the seal assembly of FIG. 2 in the expanded, inflated configuration.
Figure 7:
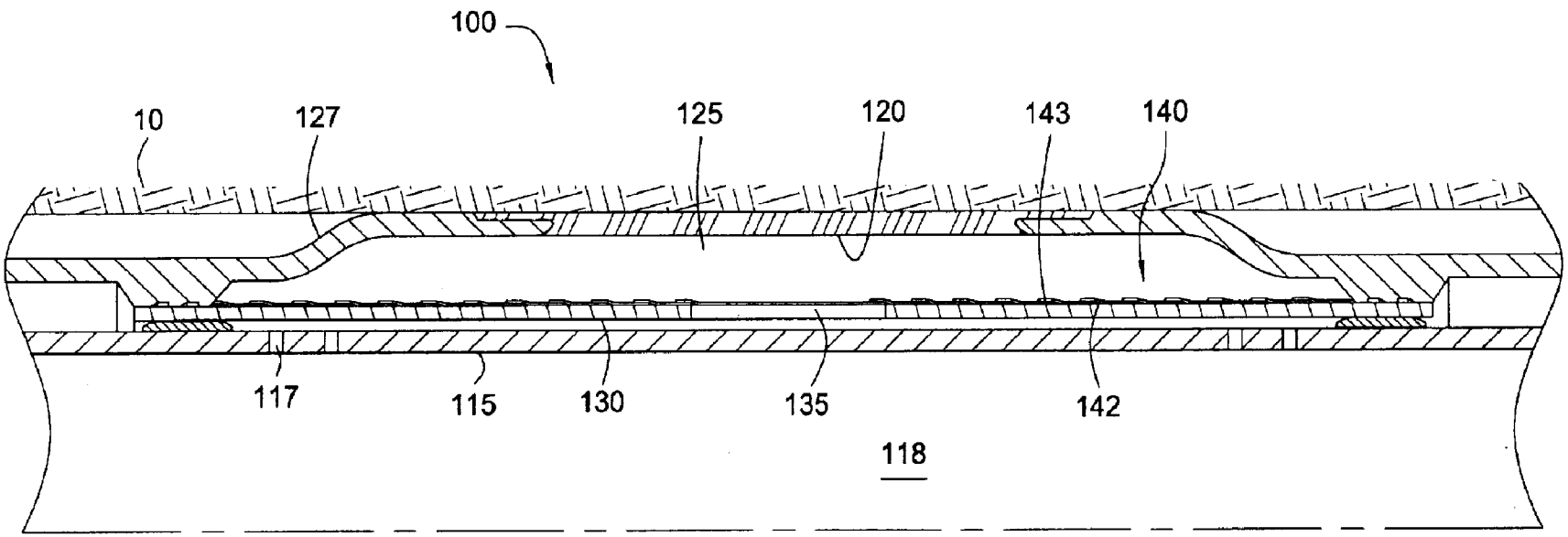
FIG. 7 is a partial cross-sectional view of the sealing member of FIG. 3 in the actuated configuration.

After the sealing members 100A, 100B have been sufficiently inflated, the pressurized fluid is released. FIG. 6 illustrates the seal assembly 50 after inflation. As a result, a pressure differential is created between the chamber 125 and the bore 118 of the mandrel 115. Particularly, the chamber 125 has a higher pressure than the hydrostatic pressure in the mandrel 115. As the fluid in the chamber 125 tries to equalize the pressures by flowing out of the chamber 125 toward the mandrel 115, the self-isolating screen 140 closes off and the pressure in the chamber 125 is applied against the permeable membrane 130, as illustrated in FIG. 7. Particularly, the pressurized fluid causes the flap 143 to flex toward the aperture 142, thereby closing off the aperture 142 for fluid communication. Moreover, the pressure in the chamber 125 causes the screen 140 to press against the membrane 130 to further close off the apertures 142. In this respect, the pressure is trapped in the chamber 125 to maintain the energized seal load. In this manner, the seal assembly 50 may be actuated to provide zone isolation.

In another aspect, an isolation plug 160 may be inserted into the ports 117 of the mandrel 115 prior to run-in, as illustrated in FIG. 3. The isolation plugs 160 may prevent premature inflation of the sealing element 127. Preferably, the isolation plugs 160 include a hollow interior. During expansion, the expander tool may break the isolation plugs 160, thereby opening the ports 117 for fluid communication. In this manner, the seals 100 may be adapted to prevent premature inflation.

Figure 8:
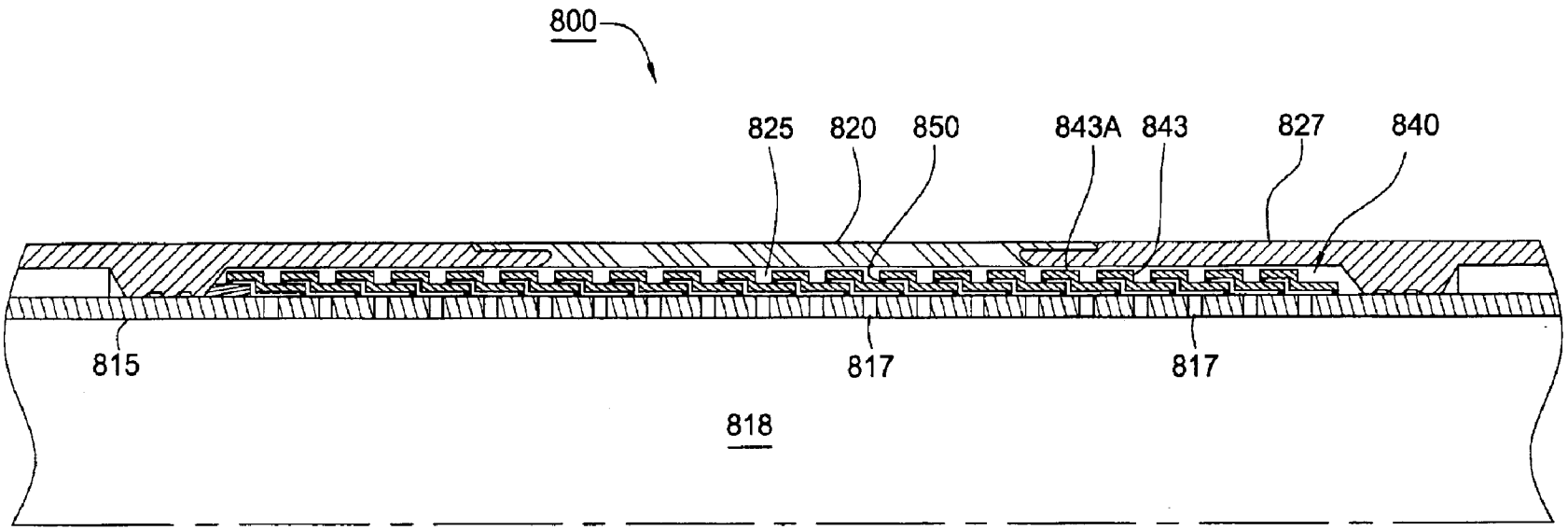
FIG. 8 is a partial cross-sectional view of another embodiment of the sealing member of the present invention. The sealing member is shown in the unactuated configuration.

FIG. 8 illustrates another embodiment of a sealing member 800 suitable for use with the seal assembly 50 according to aspects of the present invention. The sealing member 800 includes an expandable mandrel 815 and an inflatable sealing element 820 mounted on the mandrel 815. The sealing element 820 may be made from any suitable expandable material, including an elastomeric material such as a swelling elastomer or a rubber material such as natural rubber. A chamber 825 is defined between the sealing element 820 and the mandrel 815. One or more ports 817 may be formed in the mandrel 815 to provide fluid communication between the bore 818 of the mandrel 815 and the chamber 825. Fluid supplied to the chamber 825 may serve to inflate the sealing element 820. A series of reinforcing ribs 827 are disposed at each end of the sealing element 820 to provide support for the sealing element 820 after inflation. FIG. 8 shows the sealing member 800 in the run-in uninflated position.

The sealing member 800 is provided with a self-isolating layer 840 disposed around mandrel 815. The self-isolating layer 840 includes a series of flow control members 843 to regulate the flow of fluid through the ports 817. An exemplary flow control member 843 includes a flap 843 secured at one end to the mandrel and unsecured at another end, as shown in FIG. 8. The series of flaps 843 are located interior to the chamber 825 and are adapted and arranged to block off fluid communication through the ports 817. In one embodiment, the secured ends of adjacent flaps 843, 843A straddle a port 817. The free end of each flap 843 contacts or lies against a secured end of the adjacent flap 843A. Preferably, the flaps 843, 843A overlap sufficiently such that the adjacent flaps 843, 843A remain in contact after expansion. The free end may be covered or impregnated with a sealing material 850 that allows a seal to be formed between the adjacent flaps 843, 843A. The flaps 843 are actuatable by a pressure differential between the bore 818 and the chamber 825. During inflation, the flap 843 may flex away from port 817 to allow fluid to flow into the chamber 825, thereby inflating the sealing element 820. Conversely, when the pressure in the bore 818 is released, the flap 843 may bend toward the port 817 to seal off the chamber 825, thereby isolating the pressure in the chamber 825.

Figure 9:
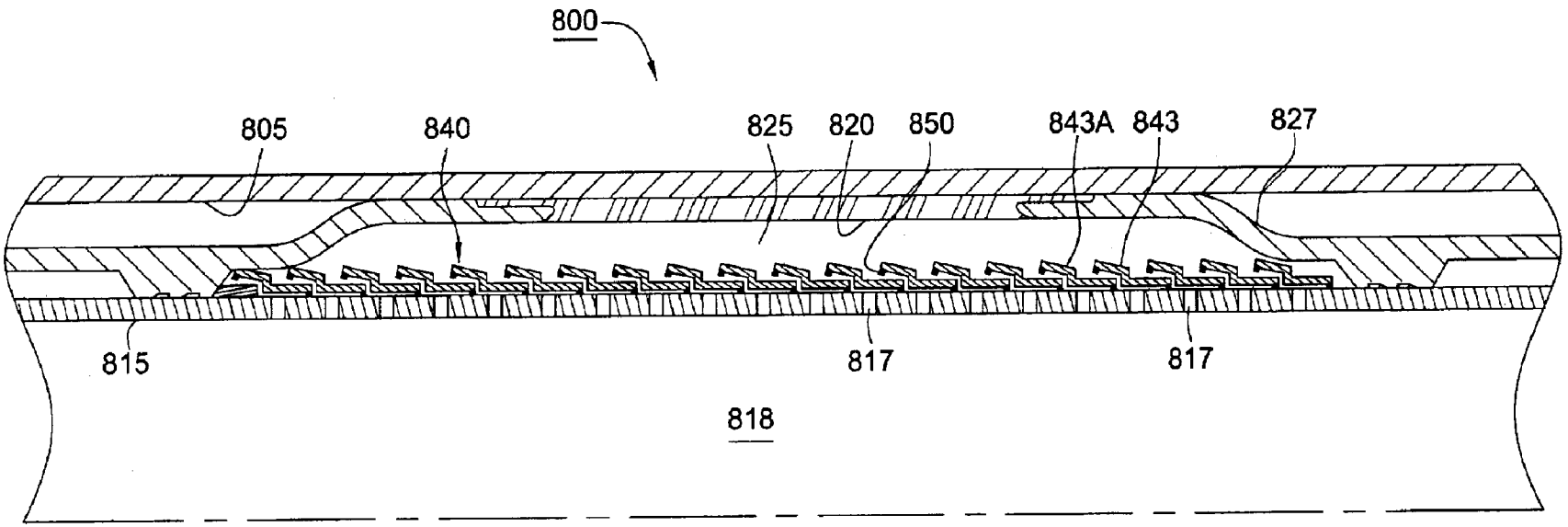
FIG. 9 is a partial cross-sectional view of the sealing member of FIG. 8 during inflation.

In operation, the seal assembly 50 is initially expanded to a greater diameter. As shown, the seal assembly 50 is expanded against a casing 805 in a wellbore 10. Thereafter, the sealing members 800 are inflated to seal off the wellbore 10. A fluid from the surface is supplied to the chambers 825 of the sealing members 800 to inflate the sealing elements 820. The fluid is initially forced through the ports 817 of the mandrel 815 and flows past the flaps 843 in the chamber 825, as illustrated in FIG. 9. As shown, the pressurized fluid causes the flap 843 to flex away from the adjacent flap 843A, thereby opening the port 817 for fluid communication. Pressurized fluid in the chamber 825 expands the sealing element 820 into contact with the wellbore 10. In this respect, a large pressure energized seal load is generated between the sealing member 820 and the wellbore 10 to provide the desired zone isolation.

Figure 10:
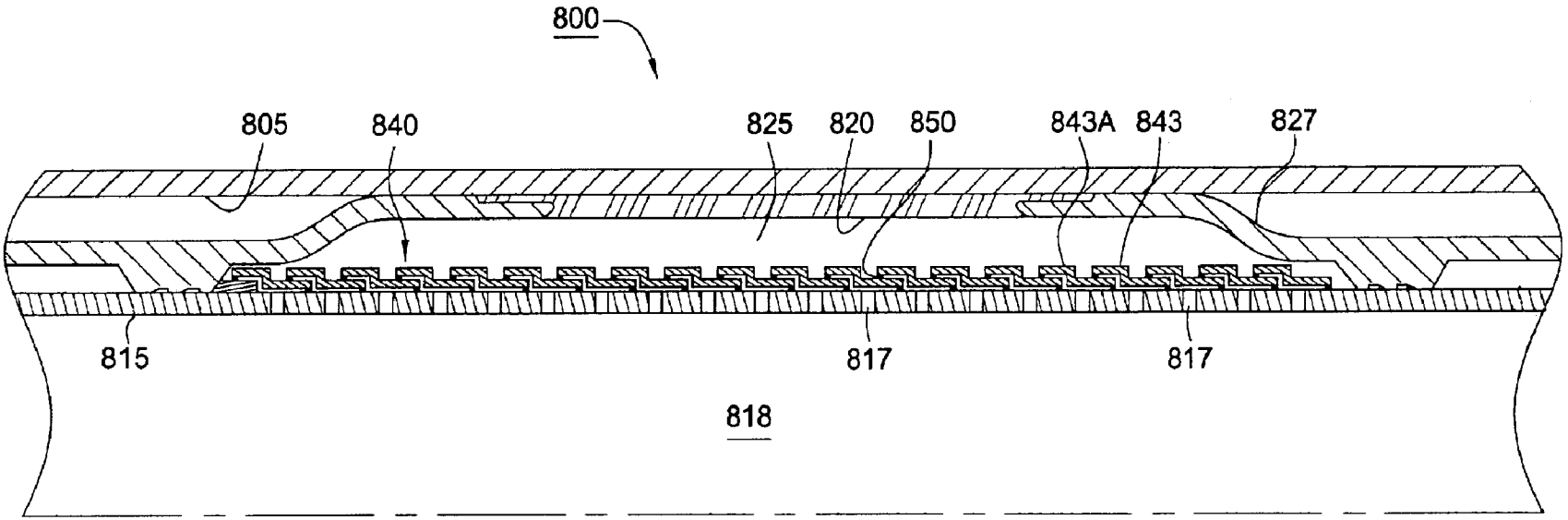
FIG. 10 is a partial cross-sectional view of the sealing member of FIG. 8 in the actuated configuration.

After the sealing members 800 have been sufficiently inflated, the pressurized fluid is released. FIG. 10 shows the sealing member 800 after inflation. As a result, a pressure differential is created between the chamber 825 and the bore 818 of the mandrel 815. Particularly, the chamber 825 has a higher pressure than the hydrostatic pressure in the mandrel 815. As the fluid in the chamber 825 tries to equalize the pressures by flowing out of the chamber 825 toward the bore 818, the pressurized fluid causes the unsecured end of the flap 843 to contact the adjacent flap 843, thereby closing off the port 817 for fluid communication. In this respect, the self-isolating layer 840 traps the pressure in the chamber 825 to maintain the energized seal load. In this manner, the seal assembly 50 may be actuated to provide zone isolation.

Figure 11:
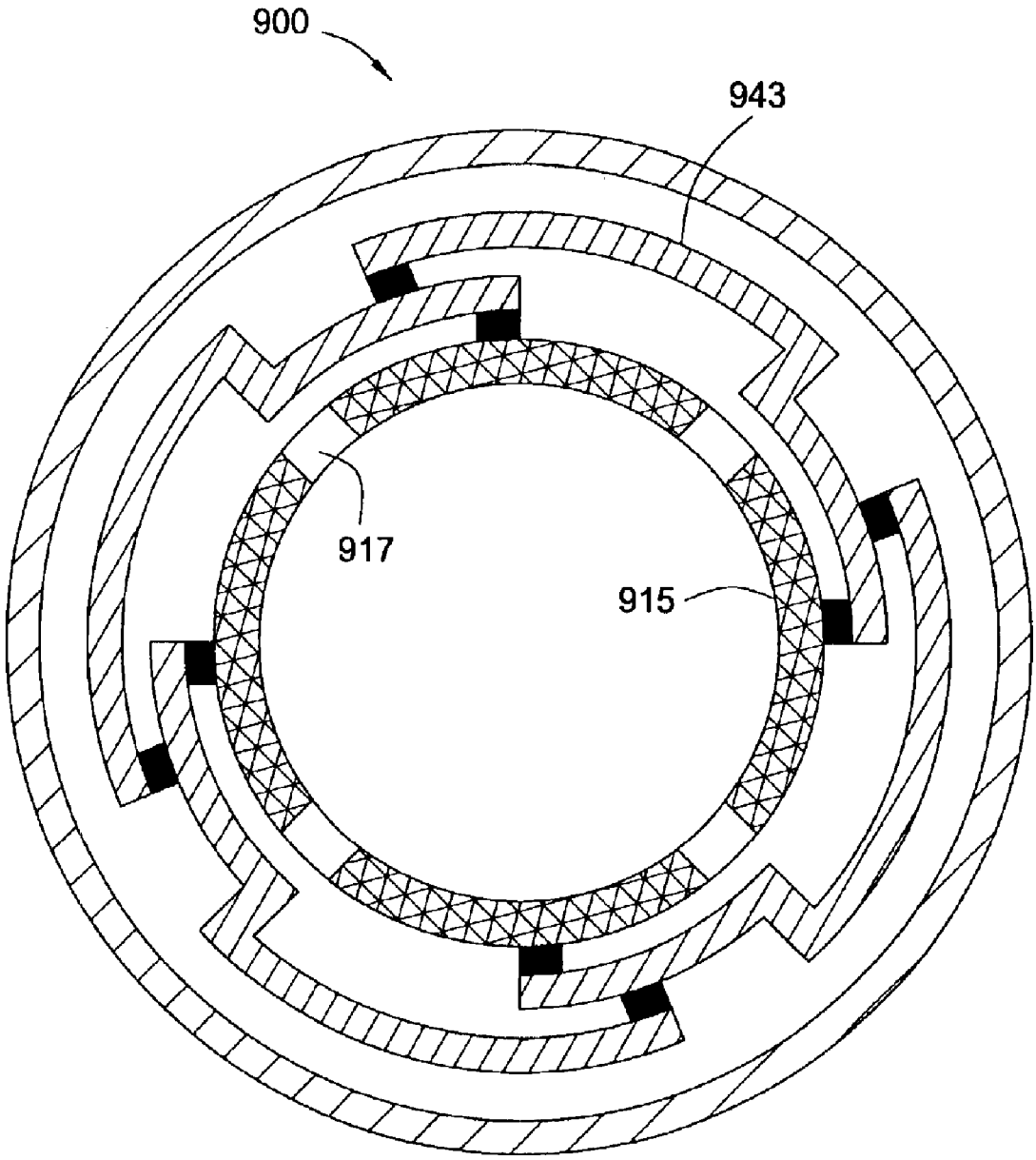
FIG. 11 is a partial cross-sectional view of another embodiment of the sealing member of the present invention. The sealing member is shown in the unactuated configuration.

Although the flow control members 143, 843 in the above embodiments are arranged axially along the mandrel 115, 815, it is understood that the flow control members may also be arranged radially around the mandrel as illustrated in FIG. 11. FIG. 11 shows a cross-sectional view of an embodiment of the sealing member 900 in which the flow control members 943 are arranged radially around the mandrel 915. The series of flow control members 943 overlap each other to regulate fluid flow through the ports 917 in the mandrel 915.

In another aspect, a solid granular filler material may be provided in the chamber. An exemplary filler material may include a mixture of bentonite (absorbent aluminum silicate clay) and a dry, powdered water soluble polymer such as polyacrylamide, as disclosed in U.S. Pat. No. 3,909,421, which patent is incorporated herein by reference. The filler material may react with the fluid supplied to the chamber to form a viscous fluid-solid mixture that cannot pass through the self-isolating screen. Additionally, the filler material increases in size as it absorbs fluid. Accordingly, the applied pressure may be relaxed once the sealing member has been inflated. As the mixture solidifies over a period of time, the pressure in the inflated chamber is retained, thereby maintaining the seal load on the wellbore.

When the filler is a bentonite/polyacrylamide mixture, water is used as the reactant fluid. When mixed with water downhole, a clay is formed, and the water soluble polymer flocculates and congeals the clay to form a much stronger and stiffer cement-like plug. Various filler materials, such as those disclosed in U.S. Pat. Nos. 4,633,950; 4,503,170; 4,475,594; 4,445,576; 4,442,241; and 4,391,925, which are herein incorporated by reference, are also suitable for use without deviating from the aspects of the present invention.

It has been observed that the seal load may change over time. This loss of seal load may be offset in several ways. First, a sealing element made of a swelling elastomer or natural rubber tends to expand as it adsorbs hydrocarbons or other fluids over a period of time. This further expansion of the sealing element enhances the seal load on the wellbore over time. Second, in situations where the sealing member is set in an unstable formation, such as an unstable formation tending to collapse inwardly over time, the re-stressed formation exert a force against the sealing element to offset the loss of seal load, thereby retaining the seal load on the formation. Third, the sealing member may be inflated to a pressure above the pore pressure of the formation. This over-pressurization maintains an effective seal load over time. Fourth, the relatively high temperatures experienced downhole tend to cause the sealing member to swell.

In another aspect, the seal assembly 50 may be located in the wellbore in a manner as to avoid or minimize restriction of the wellbore. The assembly 50 may be self-hanging by expanding the sealing members 100 into contact with the wellbore. Alternatively, an expandable anchor may be used to locate and hang the assembly 50 in the wellbore.

Figure 12:
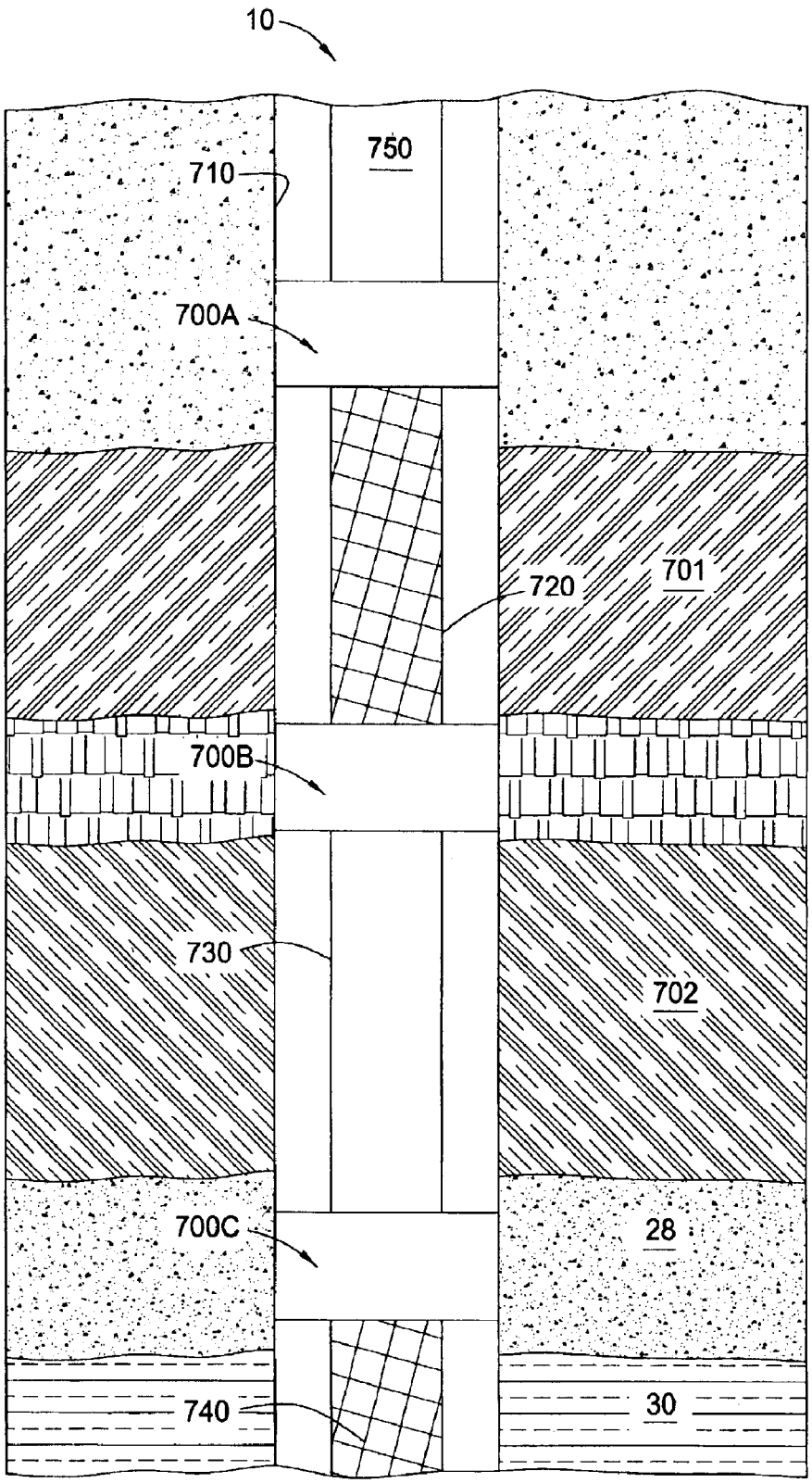
FIG. 12 is a schematic view of another embodiment of the seal assembly of the present invention.

In another aspect, the seal assembly 750 may be arranged and constructed to isolate more than one zone. FIG. 12 is a schematic view of a seal assembly 750 designed to isolate a plurality of producing and non-producing zones 701, 702, respectively. The seal assembly 750 may include a first and second sealing members 700A, 700B positioned to isolate the producing zone 701. An expandable sand screen 720 connecting the sealing members 700A, 700B allows the recovery of hydrocarbons from the producing zone 701. The seal assembly 750 may further include expandable solid tubulars 730 positioned along non-producing zones 702. As shown, a solid tubular 730 cooperate with the second and third sealing members 700B, 700C to isolate the non-producing zone 702. Furthermore, migration of fluids from the non-producing zone 702 along the wellbore annulus to the producing zone 701 is prevented. In this manner, aspects of the present invention provide a seal assembly 750 for managing multiple zones.

In another aspect, the ports, apertures, and channels in the sealing members may be of any suitable shape other than circular. For example, part of the mandrel may be slotted or otherwise perforated and on expansion may form diamond or other shaped openings.

While the foregoing is directed to embodiments of the present invention, other and further embodiments of the invention may be devised without departing from the basic scope thereof, and the scope thereof is determined by the claims that follow.

We claim:

1. An expandable sealing apparatus, comprising:

an expandable tubular;

a sealing element disposed around the tubular;

a chamber defined between the sealing element and the tubular, wherein the chamber is in selective fluid communication with the expandable tubular; and a self-isolating layer disposed in the chamber, wherein the self-isolating layer is adapted to regulate fluid flow into the chamber.

2. The sealing apparatus of claim 1, wherein the self-isolating layer is actuatable by a pressure differential.

3. The sealing apparatus of claim 1, wherein the self-isolating layer comprises one or more flow control members.

4. The sealing apparatus of claim 3, wherein the one or more flow control members are actuatable by a pressure differential.

5. The sealing apparatus of claim 3, wherein the tubular includes one or more ports for fluid communication between the chamber and a bore of the tubular.

6. The sealing apparatus of claim 3, wherein the one or more flow control members regulate fluid flow through the one or more ports.

7. The sealing apparatus of claim 3, wherein at least one of the one or more flow control members overlap another flow control member.

8. The sealing apparatus of claim 7, wherein a sealing material is disposed between overlapping flow control members.

9. The sealing apparatus of claim 3, wherein the one or more flow control members are secured at one end and unsecured at another end.

10. The sealing apparatus of claim 1, wherein the sealing element comprises an inflatable element.

11. The sealing apparatus of claim 10, wherein the sealing element is urged outward by supplying fluid to the chamber.

12. The sealing apparatus of claim 1, further comprising a plurality of reinforcing ribs.

13. The sealing apparatus of claim 1, further comprising a permeable membrane disposed between the mandrel and the self-isolating layer.

14. The sealing apparatus of claim 13, wherein the self-isolating layer is urged into contact with the membrane.

15. An expandable sealing apparatus, comprising:

an expandable tubular;

a sealing element disposed around the tubular;

a chamber defined between the sealing element and the tubular;

a pressure-isolating layer disposed in the chamber, wherein the pressure-isolating layer is adapted to regulate fluid flow into the chamber; and a permeable membrane disposed between the mandrel and the pressure-isolating layer.

16. The sealing apparatus of claim 15, wherein the pressure-isolating layer is urged into contact with the membrane.

17. A seal assembly, comprising:

an expandable tubular;

a sealing member disposed around the tubular; and a pressure isolating mechanism adapted to seal off fluid communication between the expandable tubular and the sealing member when a pressure differential is created between the expandable tubular and the sealing member.

18. The seal assembly of claim 17, further comprising a filler material disposed in the chamber.

19. The seal assembly of claim 17, wherein the pressure isolating mechanism includes at least one flow control member.

20. The seal assembly of claim 19, wherein the at least one flow control member is secured at one end and unsecured at another end.

21. The seal assembly of claim 19, further comprising a permeable membrane disposed between the pressure isolating mechanism and the expandable tubular.

22. A method for isolating a wellbore, comprising:

running a sealing apparatus into the wellbore, the sealing apparatus having:

a tubular body; and one or more sealing elements disposed around the tubular body;

expanding the sealing apparatus;

inflating the one or more sealing elements;

initiating a pressure differential between the tubular body and the one or more sealing elements; and closing off fluid communication between the tubular body and the one or more sealing elements.

23. The method of claim 22, further comprising providing the sealing apparatus with a pressure isolating mechanism adapted to close off fluid communication.

24. The method of claim 23, wherein the pressure differential actuates the pressure isolating mechanism.

25. The method of claim 23, wherein the pressure isolating mechanism comprises a self-isolating layer having one or more flow control members.

26. The method of claim 22, further comprising supplying fluid through the tubular body to inflate the sealing element.

27. The method of claim 22, wherein a pressure in the one or more sealing elements is greater than a pressure in the tubular body.

28. The method of claim 22, further comprising urging the self-isolating layer against a membrane disposed in the one or more sealing elements.

29. The method of claim 22, wherein the sealing apparatus further comprises a filler material.

30. The method of claim 22, further comprising increasing a diameter of the wellbore.

31. The method of claim 22, wherein more than one zone is isolated.

* * * * *